United States Patent [19]

Himmelsbach

[11] 4,270,910

[45] Jun. 2, 1981

[54] APPARATUS FOR SEPARATING PORTIONS OF FLAT MATERIAL CUT-OUT FROM A WEB OR SHEET

[76] Inventor: Fritz Himmelsbach, bei Papierwarenfabrik, CH-6317 Oberwil, Switzerland

[21] Appl. No.: 925,875

[22] Filed: Jul. 18, 1978

[30] Foreign Application Priority Data

Jul. 20, 1977 [DE] Fed. Rep. of Germany ..... 2732837
Aug. 10, 1977 [DE] Fed. Rep. of Germany ..... 2736030

[51] Int. Cl.[3] ..... B31B 49/00; B65H 29/64; B65H 29/42

[52] U.S. Cl. ..... 493/373; 83/100; 83/107; 83/152; 271/82; 271/196; 271/179; 271/214; 271/DIG. 10; 271/283

[58] Field of Search ..... 271/172, 196, 82, 214, 271/215, 213, 177–179, 181, DIG. 10, 280, 282, 283, 284; 83/103, 107, 102, 100, 152; 414/103, 106–108, 47; 93/36 A

[56] References Cited

U.S. PATENT DOCUMENTS

| | | | |
|---|---|---|---|
| 1,362,411 | 12/1920 | Fraser | 271/181 |
| 2,826,413 | 3/1958 | Brodie et al. | 271/179 |
| 2,930,611 | 3/1960 | Pearce | 271/177 |
| 3,410,183 | 11/1968 | Sarka | 83/100 X |
| 3,729,187 | 4/1973 | Waibel | 271/82 X |
| 3,872,752 | 3/1975 | Remde et al. | 83/100 |

*Primary Examiner*—Bruce H. Stoner, Jr.
*Attorney, Agent, or Firm*—Yount & Tarolli

[57] ABSTRACT

The invention provides apparatus for separating portions of flat material cut-out from a web or sheet. First and second grippers respectively, which engage with first and second cut portions of flat material, are provided to travel along and define paths of motion for the first and second cut portions of flat material, which paths diverge from a point of separation. A feed conveyor is connected in front of the grippers and is synchronized with their drive.

14 Claims, 8 Drawing Figures

APPARATUS FOR SEPARATING PORTIONS OF FLAT MATERIAL CUT-OUT FROM A WEB OR SHEET

The invention relates to apparatus for the separation of cut portions from flat material, in particular of offcuts from flat filter material in the production of filter bags, in which the flat material is subjected to a cutting or notching process with at least partial separation of at least one first cut portion of flat material from at least one second cut portion of flat material.

The removal of wholly or partially severed cut portions from flat material, e.g., of paper or paper-like material, foils or textile materials and the like is an important working process in the production of many objects which consist or are composed of flat blanks of such a material. Particular significance attaches to this removal of cut portions of flat material in the case of automated series or mass production with correspondingly high working speeds. In this case rapid and reliable removal of offcuts or else of cut-out useful parts or respectively the separation and elimination of the scrap on the one hand and the useful parts on the other is often a prerequisite to the troublefree maintenance of a high working speed.

A device of this kind mentioned is known from West German Patent Specification No. 654422, according to which contra-rotating suction wheels are provided for the separation of cut portions of flat material lying side by side in an approaching web. In that case it is a matter of a relatively uncritical application, because essentially only striplike cut portions must be separated from one another at their side edges and no intermediate cut portions of complicated shape have to be abstracted. Cut portions of complicated shapes like those in the case of filter bags cannot therefore be readily processed. In particular by such simple mechanisms cut portions of complicated shape with similar intermediate cut portions, following one another in the direction longitudinal to the advancing web, cannot be separated from one another safely, where the useful portions ought next to be arranged one behind the other in an accurately counted number and collected into stacks.

The object of the invention is therefore the creation of a device by means of which cut portions of flat material of in particular relatively complicated shape following one another in the direction of feed in connection with a cutting or notching process may be safely and carefully separated from one another and fed to a succeeding stacking operation.

According to the invention apparatus for the separation of pre-cut portions of a web or sheet of flat material, comprises gripper means for engaging respectively with first and second cut portions of said web or sheet of flat material, said respective gripper means defining a point of separation and being arranged to move in respective paths which diverge from said point of separation; and conveyor means for feeding said flat material to said gripper means, the motions of said conveyor means and said gripper means being synchronized with one another.

In the case of such a construction of the device, safe separation and removal of the cut portions of flat material without damage to the useful cut portions is taken care of even when the preceding cutting or notching process brings about only a partial severance of the flat material, whether because the separating process is not effected uniformly with the whole cut outline or because the whole thickness of material does not get severed as is frequently the case in notching processes without tools which actually shear right off. The latter is relevant in particular for the shaping of cut portions of flat material by means of cutting or notching rollers which exhibit at their periphery notch cutters running to correspond with the outline to be produced and cooperate with associated counter-rollers in a relative rolling process. Cut portions of flat material which are, say, only partially severed are in this case too (because of the synchronous feed to the gripper means moving divergently) reliably removed, where necessary with tearing of the remaining cross-sectional parts of the flat material.

Safe separation even in the case of tougher flat materials or cutting or notching tools which are not working completely, results in accordance with a further development of the invention if the gripper means exhibit gripper arms which are moved along a circular path and for the flat material a path of feed motion is provided which at least nearly touches the circular path of the gripper arms and if, furthermore, the gripper arms in the region of the point of contact between the circular path and the path of feed motion can be changed over from an open position to a closed position. The synchronized feed of the cut portions to be separated also enables accurate counting of the number of pieces of the useful portions to the individual stacks of a succeeding processing station, in which case again the delivery of the useful cut portions arranged in stacks is of particular significance for the subsequent packaging. Part of the object of the invention therefore is a stacking mechanism for the useful cut portions, which is made into one unit operationally with the separating device and for which the separating device acts as feed station.

In the case of usual stacking mechanisms (see, e.g. French Pat. No. 766.133) the delivery of the stacks is effected over conveyor belts consisting of rubber, lying side by side, upon which the sheetlike objects which form the stack stand by their bottom edges. Slight and often unavoidable differences between the speed of the separator members on the one hand and that of the delivery conveyor belts on the other can therefore lead to an undesirable deformation of the stack because of irregular displacements of the sheetlike objects in relation to one another, and to other trouble. This applies in any case for the stacking and the delivery in bundles of filter bags which in contrast to sheetlike objects such as newspapers and the like (see the aforesaid French Patent) are considerably more sensitive and for packing and use should have a uniform shape of stack. Furthermore, it is indeed possible to let the stack lie directly upon chains or the like which carry the separator members but the even lay necessary to uniform stack formation cannot thereby readily be achieved. A particularly advantageous further development of the invention which concerns the succeeding stacking device therefore provides that the delivery device exhibits at least one guide path for the stack, which extends in the delivery direction.

Through the arrangement of a guide path there results a uniform sliding motion of the filter bags and hence of the stack as a whole during the delivery motion because the separator members acting as carriers steadily transmit a constant driving force to the stack and the individual filter bags are subjected to a uniform sliding friction against their bottom edges and hence to a corresponding slight compression in the longitudinal direction of the stack. In accordance with a further development of the invention it is particularly advantageous to adapt the cross-sectional shape of the guide path to a sector of the outer contour of the stack being delivered, in particular by inclination of two sectors of the guide path towards one another to form a channel-like path profile corresponding with the wedgelike outer contour of filter bags lying flat. From it there results secure lateral guidance of the filter bags within the stack with a channel-like position of the bags free of play by wedge action, i.e., stack formation and stack shaping which is uniform to a high degree.

BRIEF DESCRIPTION

The invention will be further explained with the aid of the embodiment illustrated in the drawings of a separation and removal device for filter bags previously stamped or cut out of weblike flat material.

DETAILED DESCRIPTION

Figure 1:
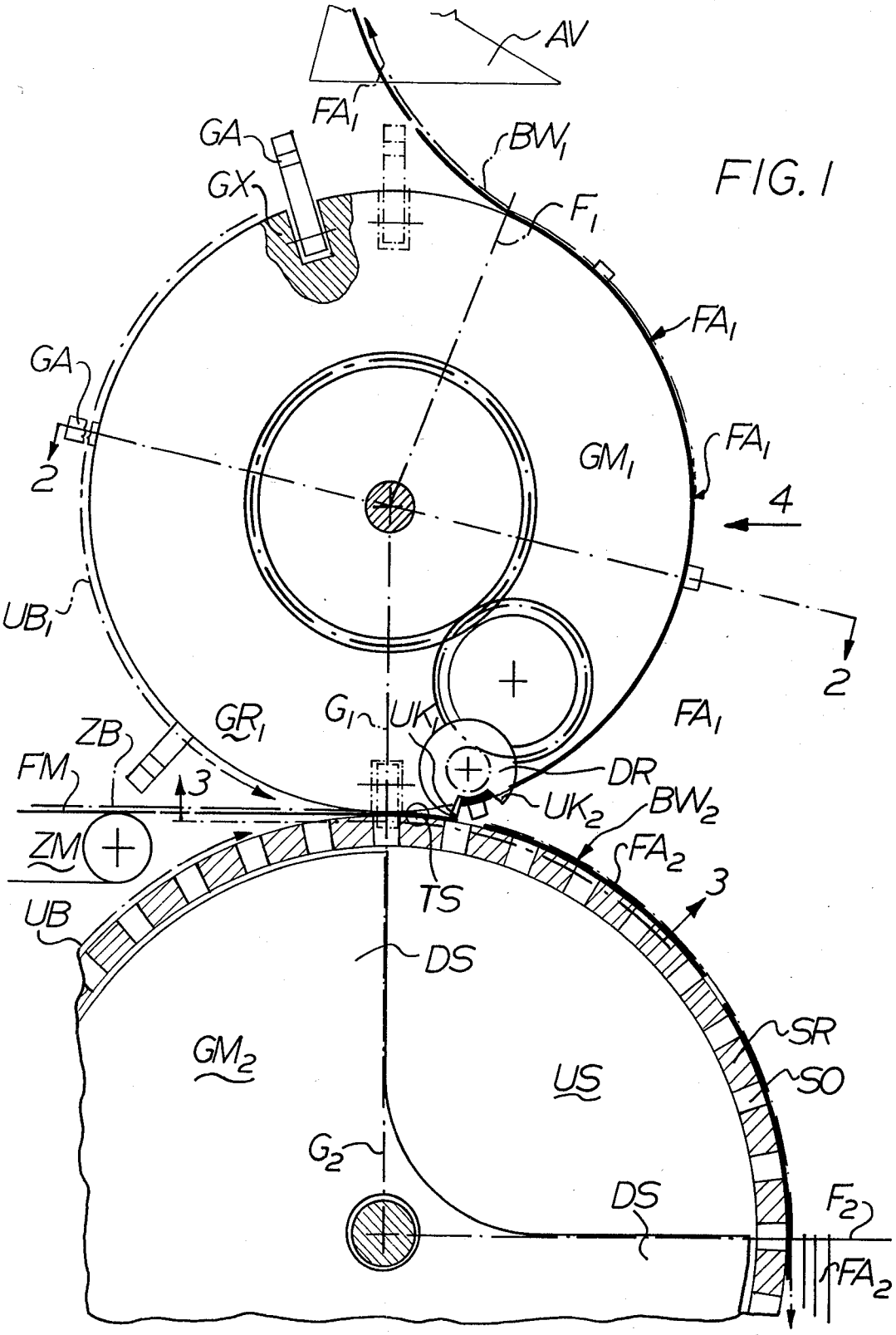
FIG. 1 shows a sectional elevation of the device with an upper gripper wheel and a lower suction wheel, seen in the direction axial to these wheels, along the section like I—I in FIG. 2.

As indicated diagrammatically in FIG. 1, a web of flat material FM which is pre-cut into first and second portions $FA_1$ and $FA_2$ (as may be seen from FIG. 2) is fed along a feed path ZB under the action of a conveyor means ZM (which for example may be a conveyor belt) between the first and second gripper means $GM_1$, $GM_{1a}$ and $GM_2$ respectively, supported in mutual rolling engagement. The first gripper means $GM_1$ and $GM_{1a}$, arranged above the guide path ZB, act upon both side edges of the flat material web FM and are accordingly spaced apart from one another across the guide path ZB (as may be seen from FIG. 2). These first gripper means, $GM_1$, $GM_{1a}$ which are associated with the first cut portion of flat material $FA_1$, each consist of a gripper wheel $GR_1$, $GR_{1a}$ having gripper arms GA arranged, around the circumference of the wheel, to move along the circular path $UB_1$ (indicated in FIG. 1 in common for $GR_1$ and $GR_{1a}$). These arms GA are supported to be able to pivot about axes GX which are arranged tangentially to an axis A common to both gripper wheels, so that the gripper arms GA in the gripping position $G_1$ (see FIG. 1) can seize the side sectors of the cut portions of flat material $FA_1$ with their holdersectors HA and press them against the circumferential surface of the associated gripper wheel.

The second gripper means $GM_2$, arranged underneath the guide path ZB, consists of a rotating suction wheel SR having a reduced-pressure channel-system US which is connected via a rotary slide valve control DS to a suction pump (not shown), and which is connected to suction members SO in the form of openings distributed round the circumference of the wheel. The rotary slide valve control DS, which basically may be substituted also by a reduced pressure control device of any other kind, so long as it is coupled to the revolving suction members, makes the reduced pressure active for those suction members which, during their revolution along the path $UB_2$, are lying between a gripping position $G_2$ and a release position $F_2$, whilst no reduced pressure is effective around the remainder of the path $UB_2$ in order to enable the release of the associated cut portions of flat material.

OPERATION

The cut portions $FA_1$ and $FA_2$ arrive along the feed path ZB (which is arranged generally tangentially to the circular paths $UB_1$ and $UB_2$ of the two gripper means, respectively the gripper arms GA on the one side and the suction members SO on the other side) in the region of the corresponding gripping positions $G_1$ and $G_2$. The feed rate is effected with synchronisation between the conveyor means ZM and the driving means (not illustrated in detail) of the gripper wheels and the suction wheel. It is thereby ensured that the gripper means $GM_1$ and $GM_{1a}$ act only upon the cut portions $FA_1$ of flat material and the gripper means $GM_2$ only upon the cut portions $FA_2$ of flat material. In the example, portions $FA_1$ are waste pieces, $FA_2$ useful pieces such as for filter bags or the like. Fundamentally, in the same way, the apparatus could also cope with a flat material in other forms.

Figure 4:
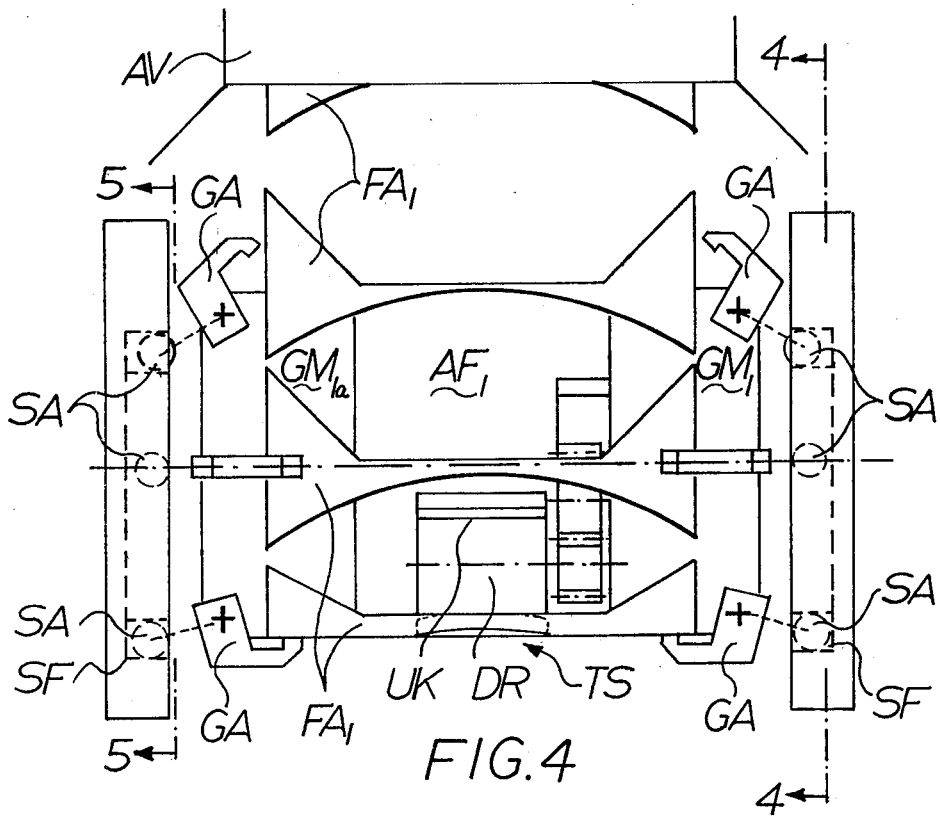
FIG. 4 is an elevation of the device along the arrow IV in FIG. 1.
Figure 5:
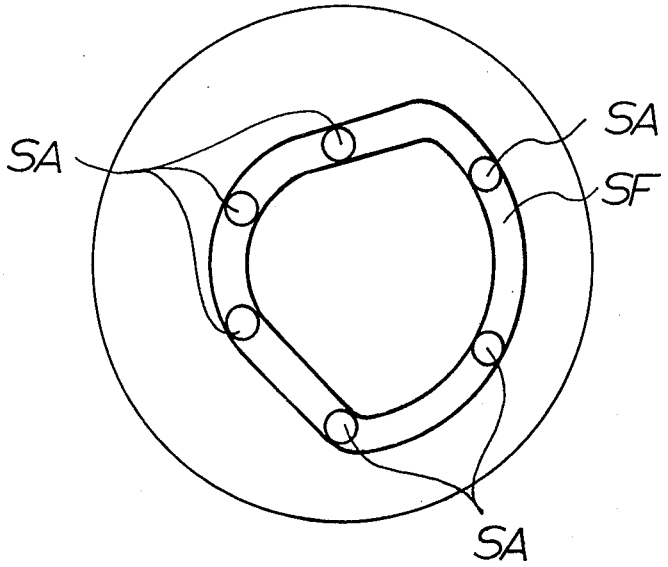
FIG. 5 is an axial elevation of a control part for the gripper wheel in accordance with the direction of view of respectively the section V—V in FIG. 4.

In the course of rotation of the gripper means the first and second cut-out portions of flat material are separated from one another and guided along the paths of motion $BW_1$ and $BW_2$ respectively which diverge from a point of separation TS (as indicated in FIG. 1). Under the action of the closed gripper arms or respectively the suction members which are subjected to the reduced pressure which has been effected, the cut-out portions $FA_2$ of flat material then arrive downwards at the (already mentioned) release position $F_2$ of the suction wheel and the portion $FA_1$ respectively upwards at a corresponding release position $F_1$. Here the cut-out portions are conveyed onwards, e.g., by means of a suction device AV which is arranged for the waste pieces in the region of the release position $F_1$. Where appropriate a similar device may also be provided for the useful pieces. The change over of the gripper arms from the closed position to the open position at $F_1$ is effected by means of control sectors SA on the arms GA which are thus cranked. These control sectors engage (in a way which may be seen from FIGS. 2 and 4) in a stationary control guide SF (illustrated in FIG. 5), which lies in a plane which is normal to the axis A. Through the corresponding radial displacement of the control sectors SA the gripper arms GA are swung between the closed position and the open position as is illustrated in FIG. 4.

Figure 2:
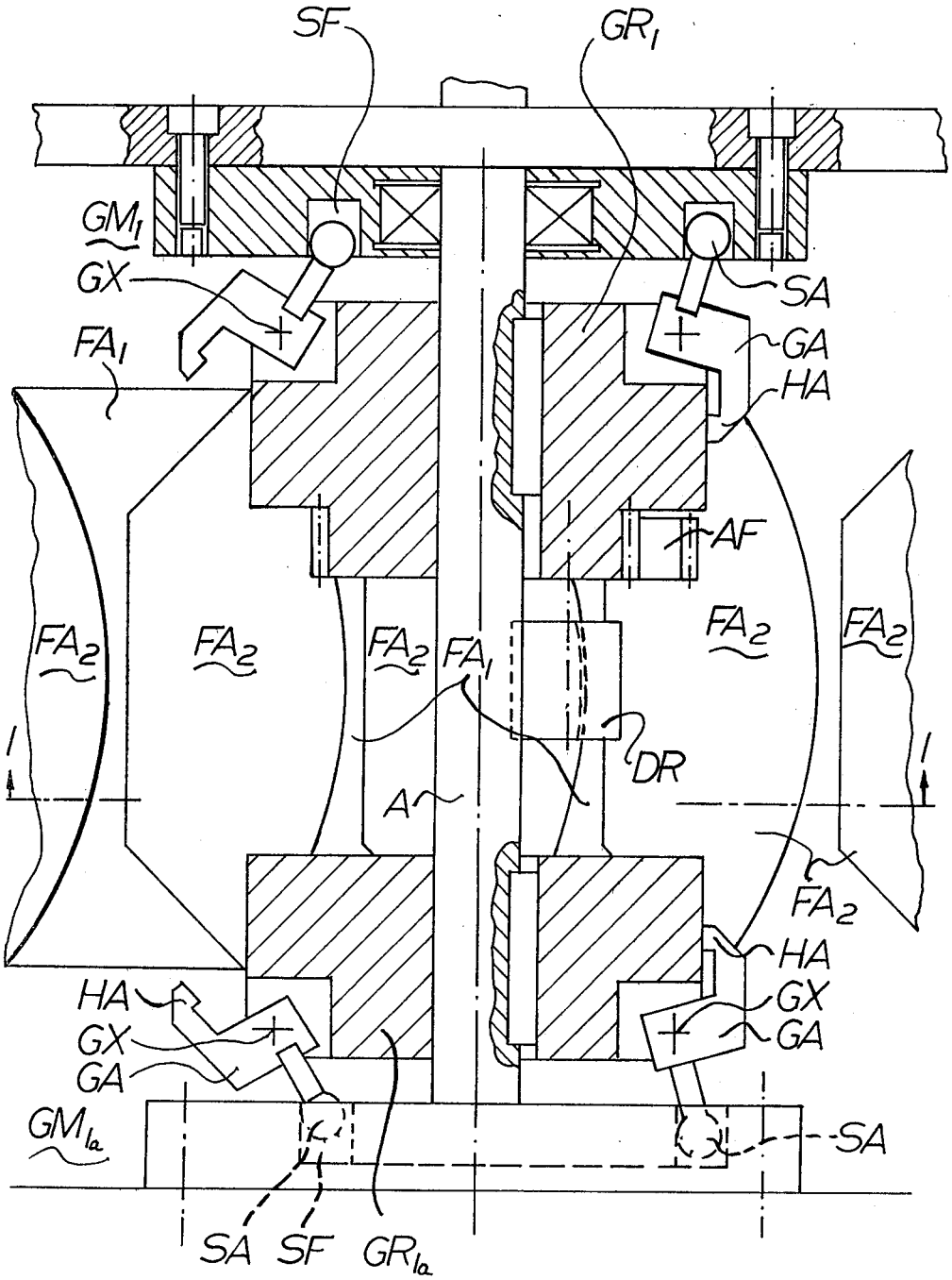
FIG. 2 is an elevation of an axial section through the gripper wheel along the section like II—II in FIG. 1.
Figure 3:
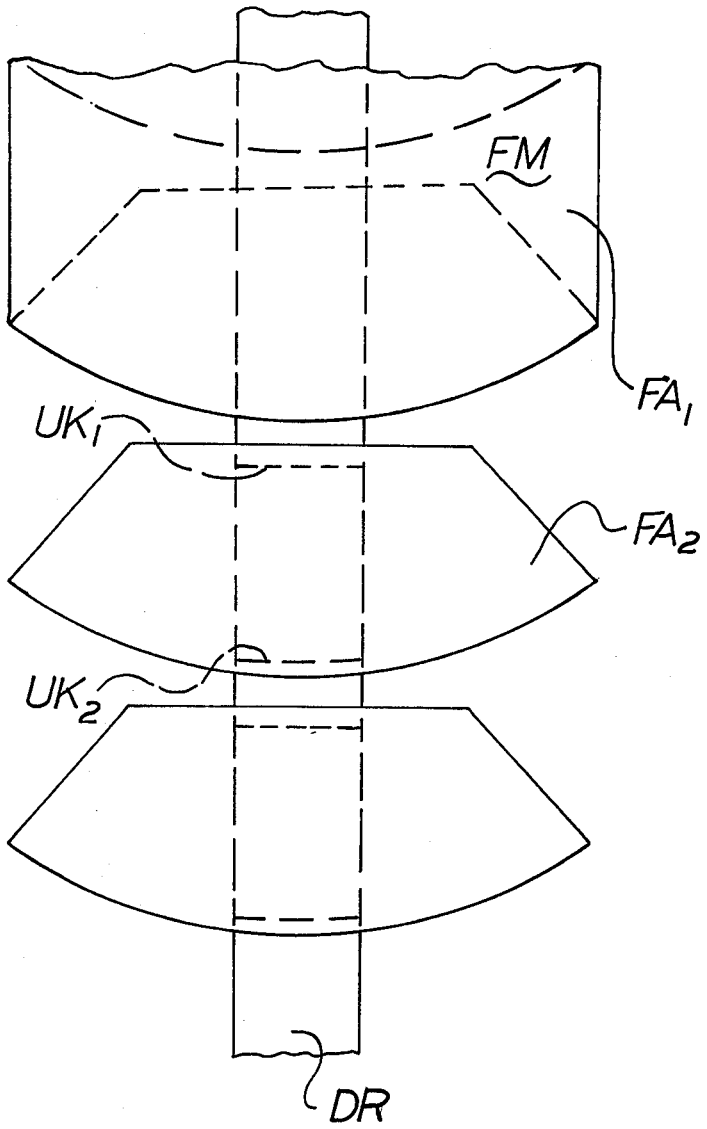
FIG. 3 is a developed illustration of a pressure wheel co-operating with the suction wheel as additional holder means.

As shown in FIGS. 1 and 2 there is further provided in the region of the circular path $UB_2$, co-operating with the circumference of the suction wheel, a roller member in the form of a pressure wheel DR which thus additionally presses the cut portions of flat material $FA_2$ against the circumference of the wheel and by circumferential edges $UK_1$ and $UK_2$ respectively having a small clearance from the edges of the outline of the cut portions of flat material $FA_2$ exerts a corresponding holding and tear-off action at the time of the separation of the cut portions $FA_1$ and $FA_2$ from one another. The operation of this additional holding means follows clearly from the developed illustration in FIG. 3. The synchronous relative rolling motion of the pressure wheel DR against the circumference of the suction wheel SR is achieved by a gearing AF coupled to the gripper wheel $GR_1$, which because of the synchronization between $GM_1$ as well as $GM_{1a}$ and $GM_2$ also brings about synchronisation with SR.

The safe and careful removal of the waste cut portions, i.e., the release of the filter bags as useful cut portions is a necessary operational prerequisite for the further processing in the form of counting a certain number into each stack. The counting and collecting of the filter bags in stacks is made possible in an advantageous way by synchronisation of a stacking device (arranged downstream) with the gripper means of the separator device which in turn are synchronised with the feed conveyor means. The overall device consisting of separator device and stacking device thus forms an operational unit.

Figure 6:
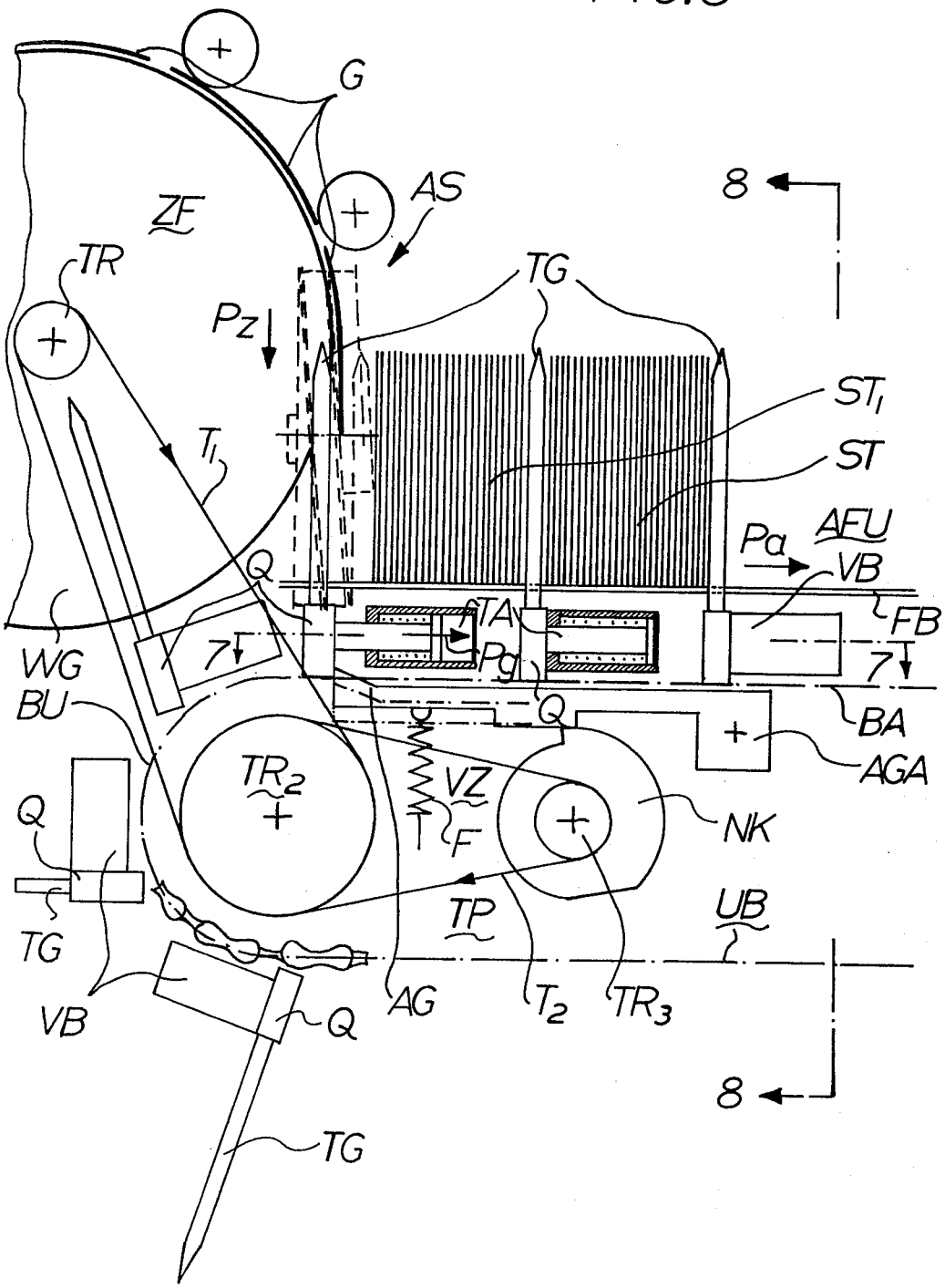
FIG. 6 is a diagrammatic side elevation of a stacking device which is arranged after a cut-portion separating device of the kind illustrated above, acting as feed station.
Figure 7:
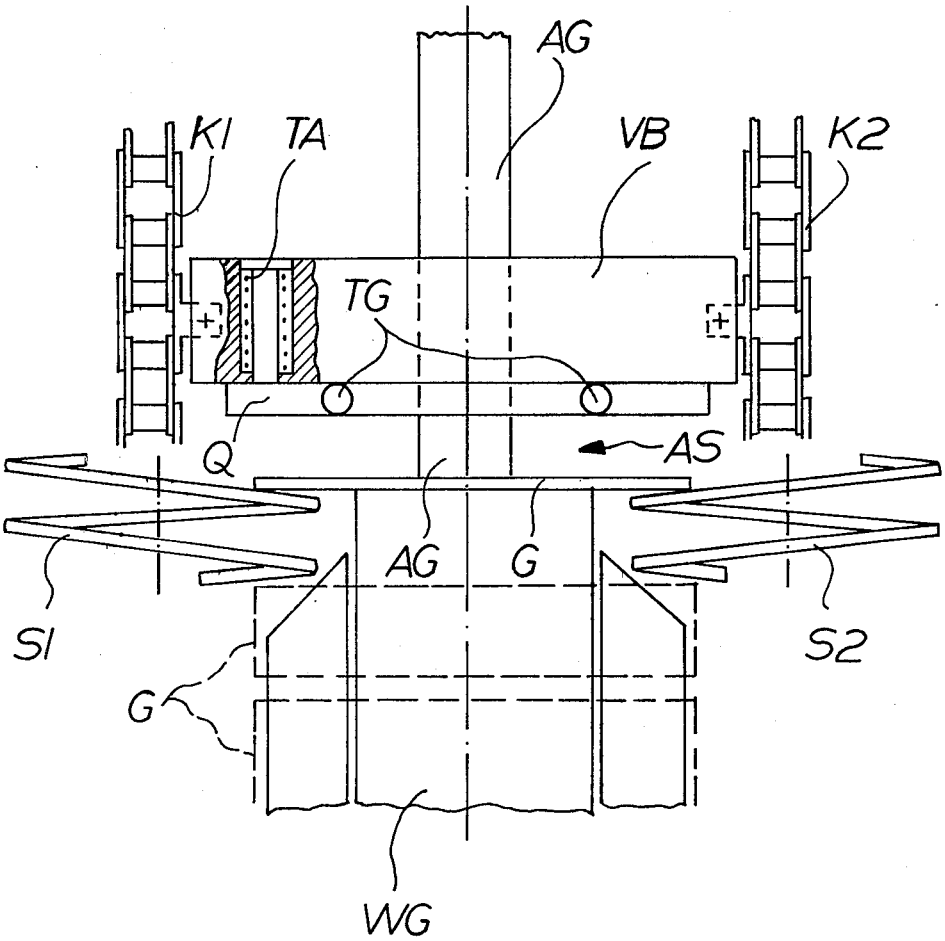
FIG. 7 is a diagrammatic partial section of the device in along the section VII—VII in FIG. 6; and, FIG. 8 is a diagrammatic partial section along the like VIII—VIII in FIG. 6.

As may be seen from FIG. 6, the stacking device comprises a feed device ZF having a wheel WG as a release member which conveys the sheets G on its circumference, as well as a delivery device AFU having conveyor means TP in the form of a chain arrangement circulating along a closed path UB which, as shown in FIG. 7, consists of a pair of conveyor chains $K_1$,$K_2$ running round in parallel. The conveyor means TP of the delivery device is coupled via a belt drive $T_1$ having wheels $TR_1$ and $TR_2$, to the feed device ZF synchronously with a certain redution ratio. The feed or respectively release direction Pz is arranged at right angles to the delivery direction Pa, so that the sheets G are concentrated in stacks ST, lying one behind another. Pinlike separator members TG are fastened in two rows arranged, in parallel with the direction of conveyance or release Pa, on connecting webs VB of the chains $K_1$ and $K_2$. The separator members TG are further arranged in pairs in alignment transversely to the direction Pa, so that a finished stack ST in each case is held between four separator members. Thus, the separator members run around the chain arrangement so that at the left hand end BU of the path of circulation UB the release member WG of the feed device engages between the rows of the separator members. By this means two separator members arrive each time behind the sheets, arriving in the direction Pz, which then are carried along by the chain arrangement over the succeeding straightline section BA of the path UB in the direction Pa. In the region of the point of engagement AS of the separator members TG with the stack ST to be delivered at the time (in FIG. 6 this is the approximately full stack $ST_1$) a delay mechanism VZ is arranged which acts transiently upon the separator members, and which here consists of a stop AG made as a rocking lever having an axis AGA. This stop (in the position shown in FIG. 6) engages with a cross-beam Q of a pair of separator members and holds this firmly against the delivery direction Pa. In order to do this each beam Q is supported to be able to slide, against a spring force, on the associated connecting web VB. The corresponding spring arrangement TA is stressed by the engagement of the stop AG against the cross beam Q and after reaching a predetermined feed position of the conveyor means TP is activated by means of a cam NK which lets the stop AG drop down quickly under the action of a release spring F, in the direction of an acceleration of the separator members in the direction Pg. In that case the pair of separator members strikes in a gap in the feed process i.e., before the next sheet arrives in the region of the tips of the separator members, in the direction Pa from behind against the stack ST which now has the required number of sheets. This feed position with triggering of the separator member drive can be determined very accurately by means of a toothed belt drive $T_2$ and an appropriately dimensioned wheel $TR_3$ on the cam NK, and thus also the number of sheets per stack. With equal safety, damage to the sheets being fed continuously, by the separator members engaging with them, can be prevented because the feed and delivery device as well as the accelerating separator member drive are in synchronised driving connection with one another. The number of sheets per stack can moreover be altered in wide limited by the appropriate ratio of reduction. For the secure formation of a tight stack and for keeping free according to the time, a gap for the separator members to pass through the sheets being fed one after another, in accordance with FIG. 7 thrust spirals $S_1$ and $S_2$ rotating about axes parallel with the delivery direction are provided on both sides of the release member, into the threads of which the sheets G slide from above and then get seized by the trust motion of the spiral and pushed against the stack being built.

The belt drive $T_1$ which connects the separator member drive via the wheel $TR_1$ with the drive of the feed device ZF can, by making use of structural means which are ordinary in themselves and are therefore not illustrated here in greater detail, be made as a gearing having an adjustable reduction ratio, e.g., by the employment of the known PIV-gear or else by means of gear-shifts which exhibit a reduction ratio adjustable in steps.

As may be seen from FIG. 6 the circulating separator members TG also bring about the conveyance of the stack ST in the direction Pa along the straight-line section BA of the path of circulation UB within the delivery device AFU. Thus the separator members are at the same time carriers for the delivery conveyance, from which results and advantageous simplification of the construction.

As is further indicated diagrammatically in FIG. 6, the pinlike separator members TB pass through corresponding longitudinal clearances in a guide path FB in the delivery device AFU, upon which the stacks ST slide in the direction Pa under the action of the separator members or carriers respectively over to a take-off station which is not shown.

Figure 8:
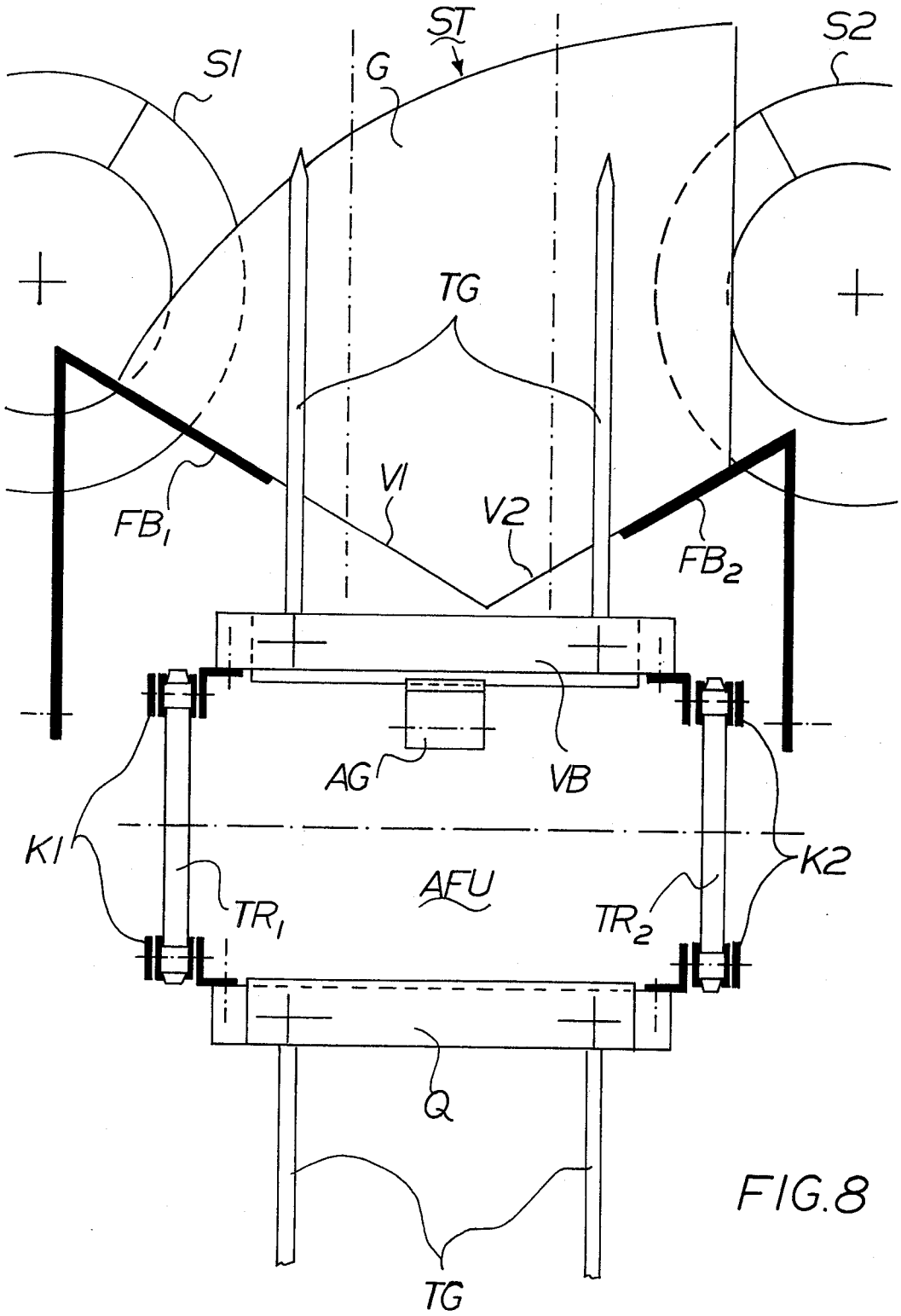

In FIG. 8 the construction of the delivery device AFU is illustrated in cross-section. In particular there is illustrated here the outer contour of the stacked object and hence the cross-sectional shape adapted to the outline of the stack, of the guide path provided by two sections $FB_1$ and $FB_2$. The filter bags which are, for example, to be stacked here, the contour of which exhibits two contour edges $U_1$, $U_2$ arranged at an angle to one another, arrive in the delivery device in an orientation which is predetermined by the production process. The sections of guide path $FB_1$ and $FB_2$ are arranged with their rest or slide faces inclined with respect to one another to form a channel-like guide profile, in which the slope is adapted to the angle between the corresponding contour edges of the objects, taking into consideration the orientation of the objects in their position of release from the production process or respectively from the feed device. From this there results a comparatively accurately aligned arrangement of the objects in the stack.

I claim:

1. Apparatus for the separation of first and second portions of a web or sheet of flat material, the first and second portions being defined by cut lines on said material, said apparatus comprising first and second gripper means for engaging respectively with the first and second cut portions of material, said respective gripper means being rotatable about parallel spaced axes to define a point of separation, and being arranged to move the first and second portions in respective paths which diverge from said point of separation, conveyor means for feeding said flat material to said gripper means, the motions of said conveyor means and said gripper means being synchronized with one another, and a rotatable roller member to separate the first and second portions of material, said roller member having on its circumference an edge conforming to at least a portion of the cut lines defining said second precut portion of material, said edge being provided by a recess formed in the circumference of said roller member, said roller member being rotatable about an axis parallel to and spaced from said axes of said gripper means and adjacent the path of the first precut portion of material and said point of separation, and said roller member being rotatable in synchronism with said gripper means whereby said edge moves along a circular path and contacts the second portion of material adjacent a cut line defining the second precut portion of material to separate said first and second precut portions.

2. An apparatus according to claim 1 wherein said first gripper means includes gripper arms which are adapted to move around a circular path which at least nearly touches the path of said flat material in said conveyor means, and means for moving said gripper arms from an open position to a closed position as said gripper arms pass said path of said flat material in said conveyor means to thereby grip the first portion of the flat material.

3. Apparatus according to claim 2, in which said first gripper means further comprises at least one gripper wheel, said gripper arms being distributed around the circumference of said wheel.

4. Apparatus according to claim 3, in which said gripper arms are pivotally supported about axes arranged tangentially to the axis of said gripper wheel, said arms including holder-sectors, said holder sectors being adapted, in their closed position, to be pressed against the circumferential surface of said gripper wheel.

5. An apparatus according to claim 2 wherein said gripper arms include control sectors, and said means for moving said gripper arms from an open position to a closed position includes a control guide in which said control sectors are guided.

6. An apparatus according to claim 1 wherein said second gripper means includes suction members, said second gripper means defining a path which at least nearly touches the path of said flat material in said conveyor means.

7. Apparatus according to claim 6, in which said second gripper means includes a rotating suction wheel, said suction wheel including a reduced pressure system having openings arranged at the circumference of the wheel to form said suction members.

8. Apparatus according to claim 7, in which said second gripper means includes a reduced-pressure-control device which is coupled with said suction members running round, said device being adapted to make the suction action inactive within a predetermined sector of said circular path for release of said cut portions of flat material carried from said second gripper means.

9. Apparatus according to claim 1, wherein said first gripper means comprises a pair of gripper means, one on each side of said feed path.

10. Apparatus according to claim 1, wherein said first and second gripper means comprise means adapted to roll one on the other.

11. Apparatus according to claim 1, wherein a suction device is provided adjacent the path of one of said gripper means, at a point on said path after said separation point, said suction means being adapted to receive said cut portions of material.

12. Apparatus according to claim 1, further including a stacking device for receiving said cut portions, said device having separator members defining individual stacks; and a delivery device for said stacks, said delivery device comprising a guidepath for said stacks.

13. Apparatus according to claim 12, in which said guide path has a cross-sectional shape adapted to a sector of the outer contour of the stack to be delivered.

14. Apparatus according to claim 13, wherein said guidepath exhibits two sectors inclined towards one another to form a channel-like guideprofile.

* * * * *